US005294267A

United States Patent [19]

Bania et al.

[11] Patent Number: 5,294,267

[45] Date of Patent: Mar. 15, 1994

[54] METASTABLE BETA TITANIUM-BASE ALLOY

[75] Inventors: Paul J. Bania, Boulder City; Warren M. Parris, Las Vegas, both of Nev.

[73] Assignee: Titanium Metals Corporation, Denver, Colo.

[21] Appl. No.: 986,086

[22] Filed: Dec. 4, 1992

[51] Int. Cl.[5] ..... C22C 14/00

[52] U.S. Cl. ..... 148/421; 148/407; 420/417; 420/418

[58] Field of Search ..... 420/417, 418; 148/407, 148/421

[56] References Cited

U.S. PATENT DOCUMENTS 3,986,868 10/1976 Crossley ..... 420/418
5,124,121 6/1992 Ogawa et al. ..... 148/669
5,160,554 11/1992 Bania et al. ..... 420/420

FOREIGN PATENT DOCUMENTS 0544701 3/1977 U.S.S.R. ..... 420/418

OTHER PUBLICATIONS

Chait et al. in Titanium Science & Technology (ed. Jaffee et al.), vol. 2, Plenum, N.Y. 1973, p. 1377.

*Primary Examiner*—Upendra Roy
*Attorney, Agent, or Firm*—Finnegan, Henderson, Farabow, Garrett & Dunner

[57] ABSTRACT

A metastable beta titanium-base alloy of Ti-Fe-Mo-Al, with a MoEq. greater than 16, preferably greater than 16.5 and preferably 16.5 to 20.5 and more preferably about 16.5. The alloy desirably exhibits a minimum percent reduction in area (% RA) of 40%. Preferred composition limits for the alloy, in weight percent, are 4 to 5 Fe, 4 to 7 Mo, 1 to 2 Al, up to 0.25 oxygen and balance Ti.

18 Claims, 2 Drawing Sheets

METASTABLE BETA TITANIUM-BASE ALLOY

BACKGROUND OF THE INVENTION

1. Field of the Invention

The invention relates to a metastable beta titanium-base alloy of titanium-iron-molybdenum-aluminum.

2. Description of the Prior Art

In the automotive industry, it is advantageous to use components in the manufacture of a motor vehicle that are of lower weight than conventional components. This is desirable from the overall standpoint of manufacturing motor vehicles having increased fuel efficiency. To this end, it has been recognized as advantageous to produce motor vehicle springs, and particularly automotive coil springs, from a high-strength titanium base alloy. More specifically in this regard, high-strength metastable beta titanium-base alloys heat treatable to tensile strengths of about 180 ksi would be well suited for this purpose and achieve weight savings of about 52% and volume reduction of about 22% relative to an equivalent, conventional automotive coil spring made from steel.

Although the properties of these titanium alloys are well suited for this and other automotive applications, the cost relative to steel is prohibitively high. Consequently, there is a need for a titanium alloy having the desired combination of strength and ductility for use in the manufacture of automotive components, such as automotive coil springs, with a low-cost alloy content.

SUMMARY OF THE INVENTION

It is accordingly a primary object of the present invention to provide a metastable beta titanium-base alloy that is low cost and has a good combination of strength and ductility.

A more particular object of the invention is to provide a titanium alloy having these characteristics that can be made from relatively low cost alloying elements.

In accordance with the invention, a metastable beta titanium-base alloy comprises Ti-Fe-Mo-Al, with the alloy having a MoEq. (molybdenum equivalence defined below) greater than 16. More specifically, the MoEq. is greater than 16.5, preferably 16.5 to 21 or 20.5 and more preferably about 16.5.

The alloy desirably exhibits a minimum percent reduction in area (% RA) of 40% in a room-temperature tensile test.

Preferred composition limits for the alloy, in weight percent, are 4 to 5 Fe, 4 to 7 Mo, 1 to 2 Al, up to 0.25 oxygen and balance Ti.

DESCRIPTION OF THE PREFERRED EMBODIMENTS

Figure 1:
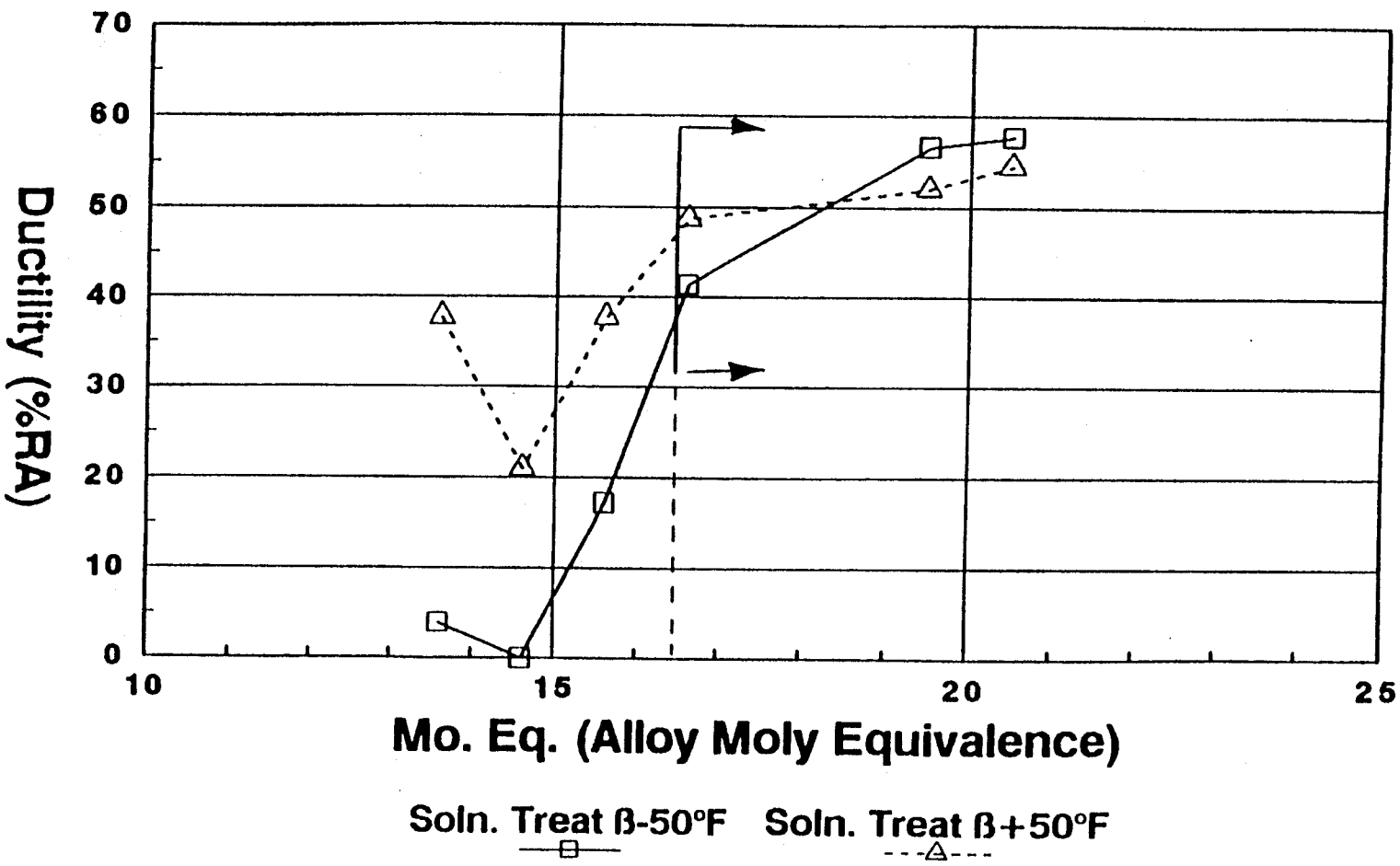
FIG. 1 is a graph relating MoEq. to ductility as a RA for alloy samples in the solution treated condition.

The relatively high cost of conventional metastable beta alloys of titanium is due significantly to the high cost of the beta stabilizing elements, such as vanadium, molybdenum and niobium. The alloying additions of these elements are typically made by the use of a master alloy of the beta stabilizing element with aluminum. It is advantageous, therefore, to produce a lower cost alloy of this type to employ lower cost master alloys. Although iron is a known beta stabilizer and is of relatively low cost, when conventionally employed it results in undesirable segregation during melting, which in turn degradates the heat-treatment response and thus the ductility of the alloy.

TABLE 1

| Common Beta Stabilizing Elements | βc for Each Element[1] | Moly Equivalent (Mo. Eq.)[2] |
|---|---|---|
| Mo | 10.0 | 1.0 |
| V | 15.0 | .67 |
| Fe | 3.5 | 2.9 |
| Cr | 6.3 | 1.6 |
| Cb(Nb) | 36.0 | .28 |

[1]βc = Critical amount of alloying element required to retain 100% beta upon quenching from above beta transus.

$$^{2}\text{Mo. Eq for Element A} = \frac{\beta c \text{ for Moly}}{\beta c \text{ for Element A}} = \frac{10}{\beta c \text{ for Element A}}$$

The selected known beta stabilizers listed in Table 1 are identified relative to the beta stabilization potential for each of these listed elements. This is defined as Molybdenum Equivalence (MoEq.). By the use of MoEq., molybdenum is used to provide a baseline for comparison of the beta stabilization potential for each of the beta stabilizing elements relative to molybdenum as shown in Table 1. By examining beta stabilization with MoEq. as a common base, it is then possible to compare various metastable beta alloys of titanium.

TABLE 2

| Common Metastable Beta Alloys | Alloy Mo. Eq.* |
|---|---|
| Ti—15V—3Cr—3Sn—3Al—.1Fe (15/3) | 15.14 |
| Ti—3Al—8V—6Cr—4Zr—4Mo—.1Fe (Beta C) | 16.25 |
| Ti—15Mo—2.8Nb—3Al—.2Fe (21S) | 13.36 |
| Ti—13V—11Cr—3Al—.1Fe (B120 VCA) | 23.6 |
| Ti—11.5Mo—6Zr—4Sn (Beta III) | 11.5 |
| Ti—10V—2Fe—3Al (10/2/3) | 9.5 |

Alloy Mo. Eq. = 1(wt. % Mo) + .67(wt. % V) + 2.9(wt. % Fe) + 1.6(wt. % Cr) + .28(wt. % Nb) − 1.0(wt. % Al)

Table 2 provides a comparison of common metastable beta alloys of titanium with A, B . . . representing the beta stabilizing elements shown in Table 1 in the following formula. It should be noted with respect to this formula, that the alpha stabilizer aluminum is assigned a value of −1.0 relative to molybdenum, and tin and zirconium are considered neutral from the standpoint of alpha and beta stabilization and therefore are not included in the formula.

$$\text{Alloy MoEq.} = (\text{Wt. \% A})(\text{MoEq. A}) + (\text{Wt. \% B})(\text{MoEq. B}) + \ldots - 1(\text{Wt. \% Al})$$

Consequently, for purposes of defining the invention in the specification and claims of this application, MoEq. is determined in accordance with this formula.

The first five alloys listed in Table 2 are known to readily retain 100% beta structure upon quenching from above the beta transus temperature. The sixth alloy designated as 10/2/3 on the other hand sometimes transforms partially to martensite upon quenching. Consequently, generally alloy MoEq. values over 9.5 in accordance with the above formula would be expected to retain a fully beta structure upon quenching from above the beta transus temperature. These alloys when quenched to a substantially fully beta structure are known to be highly ductile in that state and thus may be readily formed into rod or bar stock by conventional cold-drawing practices and thereafter formed into springs by conventional cold winding.

To provide an alloy that through the use of relatively low cost beta-stabilizer elements is cost efficient for the aforementioned automotive spring applications, a master alloy of molybdenum and iron, typically 60% molybdenum 40% iron, was used in the production of the alloys listed on Table 3.

TABLE 3

| Alloy | Composition | Mo. Eq.* |
|---|---|---|
| A | Ti—4Fe—4Mo—1Al-.150$_2$ | 14.6 |
| B | Ti—4Fe—4Mo—2Al-.150$_2$ | 13.6 |
| C | Ti—4Fe—6Mo—1Al-.150$_2$ | 16.6 |
| D | Ti—4Fe—6Mo—2Al-.150$_2$ | 15.6 |
| E | Ti—5Fe—7Mo—1Al-.150$_2$ | 20.5 |
| F | Ti—5Fe—7Mo—2Al-.150$_2$ | 19.5 |

*See Table 2 for calculation method.

This master alloy offers the advantage of permitting a low cost molybdenum addition while avoiding large aluminum additions associated with molybdenum-aluminum master alloys typically used for this purpose. The master alloy of molybdenum and iron has heretofore found use primarily in steel manufacturing. This master alloy typically costs $3.55 to $4.15 per pound of contained molybdenum compared to $13.50 to $14.50 per pound of contained molybdenum for the aluminum and molybdenum master alloy. The segregation problem discussed above resulting from the use of significant iron additions to titanium-base alloys of this type is reduced by the use of the molybdenum iron master alloy, since molybdenum segregates in an opposite direction to iron and thus to a significant extent compensates for iron segregation.

The alloys listed in Table 3 were produced as 30-pound heats by standard double vacuum arc remelting (VAR) processing. Six inch diameter ingots of each of the alloys were hot forged to 1.25 inch square cross-section and finally hot rolled to a nominal diameter of 0.50 inches. The round bar was then cut into sections for tensile testing as a function of heat treatment.

TABLE 4

Tensile Properties of Invention Alloys[1]

| Alloy[2] | Condition[3] | YS (ksi) | UTS (ksi) | % El | % RA | Mo. Eq.[2] |
|---|---|---|---|---|---|---|
| A | ST(1) | Broke Before Yield | | 0 | 0 | 14.6 |
| | ST(2) | 180 | 188 | 6.3 | 21.0 | 14.6 |
| B | ST(1) | 146 | 158 | 0.8 | 3.9 | 13.6 |
| | ST(2) | 168 | 152 | 14.8 | 37.8 | 13.6 |
| C | ST(1) | 159 | 167 | 12.8 | 41.4 | 16.6 |
| | ST(2) | 158 | 166 | 15.0 | 48.7 | 16.6 |
| D | ST(1) | 142 | 151 | 6.5 | 17.2 | 15.6 |
| | ST(2) | 146 | 155 | 13.5 | 37.8 | 15.6 |
| E | ST(1) | 143 | 149 | 20.8 | 57.7 | 20.5 |
| | ST(2) | 145 | 151 | 21.3 | 54.5 | 20.5 |
| F | ST(1) | 135 | 140 | 24.0 | 56.6 | 19.5 |
| | ST(2) | 142 | 147 | 21.0 | 52.0 | 19.5 |

[1]Avg of duplicate tests in all cases.
[2]See Table 3.
[3]ST(1) = Solution treated 50° F. over beta transus + water quenched.
ST(2) = Solution treated 50° F. below beta transus + water quenched.

Table 4 lists the tensile properties for each of the alloys of Table 3. These alloys have been solution treated by the two practices set forth in Table 4. Specifically, in the practice designated as ST(1), the material was solution treated at 50° F. over the beta transus temperature of each particular alloy. With the practice designated as ST(2), the material was solution treated at 50° F. below the respective beta transus temperature of each alloy. With both of these practices, the solution treatment involved heating for ten minutes at the desired temperature followed by water quenching of the 0.5 inch diameter tensile specimens. Following quenching, the specimens were machined and tested at room temperature. Each value reported in Table 4 represents an average of two tests.

The data in Table 4 was used to formulate the ductility plot of FIG. 1. In FIG. 1, ductility is expressed as a percent RA. The data from Table 4 and FIG. 1 clearly show a severe ductility drop for alloys treated by either solution treatment practice when the MoEq. is in the 14 to 15 range. It should be noted, however, that this drop is more severe for solution treatment above the beta transus than for solution treatment below the beta transus. For the cold drawing and spring winding operations typically used in the production of automotive springs, a ductility of RA minimum 40% is desirable, which requires a MoEq. within the aforementioned limits of the invention.

To demonstrate the strength/ductility combinations possible with the Table 3 alloys, followed by air cooling from a solution-treatment temperature, the following aging cycles were applied to one-half inch diameter bars of each alloy following a beat −50° F. solution treatment; 900° F./24 hours; 1000° F./8 hours; 1100° F./8 hours; and 1200° F./8 hours. The results are summarized in Table 5.

TABLE 5

Aged Tensile Properties of Table 3 Alloys

| Al | Fe | Mo | Aging Cycle | UTS.Ksi | YS.ksi | % RA | % Elong |
|---|---|---|---|---|---|---|---|
| 1 | 4 | 4 | A | 204.6 | 190.8 | 19.9 | 7.5 |
| | | | | 203.5 | 184.9 | 17.1 | 7.5 |
| | | | B | 187.9 | 170.0 | 29.0 | 10.0 |
| | | | | 187.8 | 168.9 | 27.0 | 8.5 |
| | | | C | 178.7 | 164.8 | 38.6 | 10.5 |
| | | | | 176.5 | 164.4 | 33.2 | 8.5 |
| | | | D | 154.4 | 144.0 | 48.4 | 16.0 |
| | | | | 157.1 | 148.6 | 48.8 | 17.5 |
| 2 | 4 | 4 | A | 214.7 | 192.8 | 22.6 | 7.5 |
| | | | | 216.3 | 194.9 | 22.2 | 7.5 |
| | | | B | 196.0 | 180.9 | 36.7 | 10.5 |
| | | | | 195.6 | 181.3 | 37.7 | 11.0 |
| | | | C | 175.1 | 165.5 | 45.7 | 14.0 |
| | | | | 175.4 | 164.3 | 46.3 | 13.0 |
| | | | D | 156.8 | 148.5 | 50.1 | 17.0 |
| | | | | 155.2 | 146.7 | 49.1 | 17.0 |
| 1 | 4 | 6 | A | 227.7 | 220.7 | 14.7 | 5.5 |
| | | | | 228.3 | 220.5 | 15.5 | 5.5 |
| | | | B | 199.6 | 193.1 | 34.8 | 10.0 |
| | | | | 199.3 | 191.8 | 35.7 | 12.0 |
| | | | C | 175.4 | 168.4 | 49.3 | 13.0 |
| | | | | 179.9 | 173.0 | 35.7 | 13.0 |
| | | | D | 151.6 | 146.4 | 57.4 | 18.5 |
| | | | | 157.2 | 150.3 | 47.7 | 18.5 |
| 2 | 4 | 6 | A | 247.3 | 237.5 | 5.0 | 2.0 |
| | | | | 248.3 | 237.2 | 3.9 | 4.5 |
| | | | B | 219.5 | 209.6 | 17.0 | 6.0 |
| | | | | 220.9 | 210.7 | 11.8 | 6.0 |
| | | | C | 193.2 | 185.3 | 27.7 | 8.0 |
| | | | | 192.2 | 184.1 | 30.7 | 8.0 |
| | | | D | 166.3 | 159.7 | 41.5 | 13.0 |
| | | | | 165.6 | 159.2 | 46.1 | 13.0 |
| 1 | 5 | 7 | A | 244.3 | 236.1 | 0.0 | 0.00 |
| | | | | 245.6 | 237.5 | 2.2 | 1.0 |
| | | | B | 214.8 | 205.8 | 9.2 | 3.0 |
| | | | | 216.0 | 207.9 | 14.0 | 6.0 |
| | | | C | 182.2 | 175.9 | 38.3 | 12.0 |
| | | | | 183.9 | 177.9 | 34.0 | 11.0 |
| | | | D | 162.5 | 156.8 | 46.4 | 17.0 |
| | | | | 162.9 | 157.0 | 45.4 | 17.0 |
| 2 | 5 | 7 | A | 247.3 | 239.5 | 3.1 | 2.0 |

TABLE 5-continued

Aged Tensile Properties of Table 3 Alloys

| Al | Fe | Mo | Aging Cycle | UTS.Ksi | YS.ksi | % RA | % Elong |
|---|---|---|---|---|---|---|---|
| | | | | 245.9 | 238.3 | 8.7 | 2.0 |
| | | | B | 219.2 | 212.4 | 22.0 | 8.0 |
| | | | | 220.0 | 213.1 | 11.4 | 7.0 |
| | | | C | 191.5 | 186.3 | 34.6 | 12.0 |
| | | | | 190.7 | 185.6 | 33.5 | 12.0 |
| | | | D | 170.3 | 165.4 | 35.5 | 15.0 |
| | | | | 168.8 | 163.6 | 39.6 | 16.0 |

Aging Cycle
A - Beta transus 50F(10 min)AC + 900F(24 hrs)AC
B - Beta transus 50F(10 min)AC + 1000F(8 hrs)AC
C - Beta transus 50F(10 min)AC + 1100F(8 hrs)AC
D - Beta transus 50F(10 min)AC + 1200F(8 hrs)AC The data in Table 5 can be analyzed by linear regression analysis to generate an equation of the form: % RA=c(UTS)+b, where c and b are constants and UTS equals ultimate tensile strength. By formulating an equation of this character for each alloy, it is possible to determine the expected "calculated" ductility at any UTS level.

TABLE 6

| | Calculated % RA[1] At 200 ksi UTS | Mo. Eq.[2] |
|---|---|---|
| Ti—4Fe—4Mo—1Al-.15$O_2$ | 21.1 | 14.6 |
| Ti—4Fe—4Mo—2Al-.15$O_2$ | 32.3 | 13.6 |
| Ti—4Fe—6Mo—1Al-.15$O_2$ | 32.4 | 16.6 |
| Ti—4Fe—6Mo—2Al-.15$O_2$ | 26.2 | 15.6 |
| Ti—5Fe—7Mo—1Al-.15$O_2$ | 24.6 | 20.5 |
| Ti—5Fe—7Mo—2Al-.15$O_2$ | 26.5 | 19.5 |

[1]Calculated from Table 5 data using least squares linear curve fit for each alloy of the form:
% RA = c (UTS) + b (c,b = constants)
[2]See Table 3.

Figure 2:
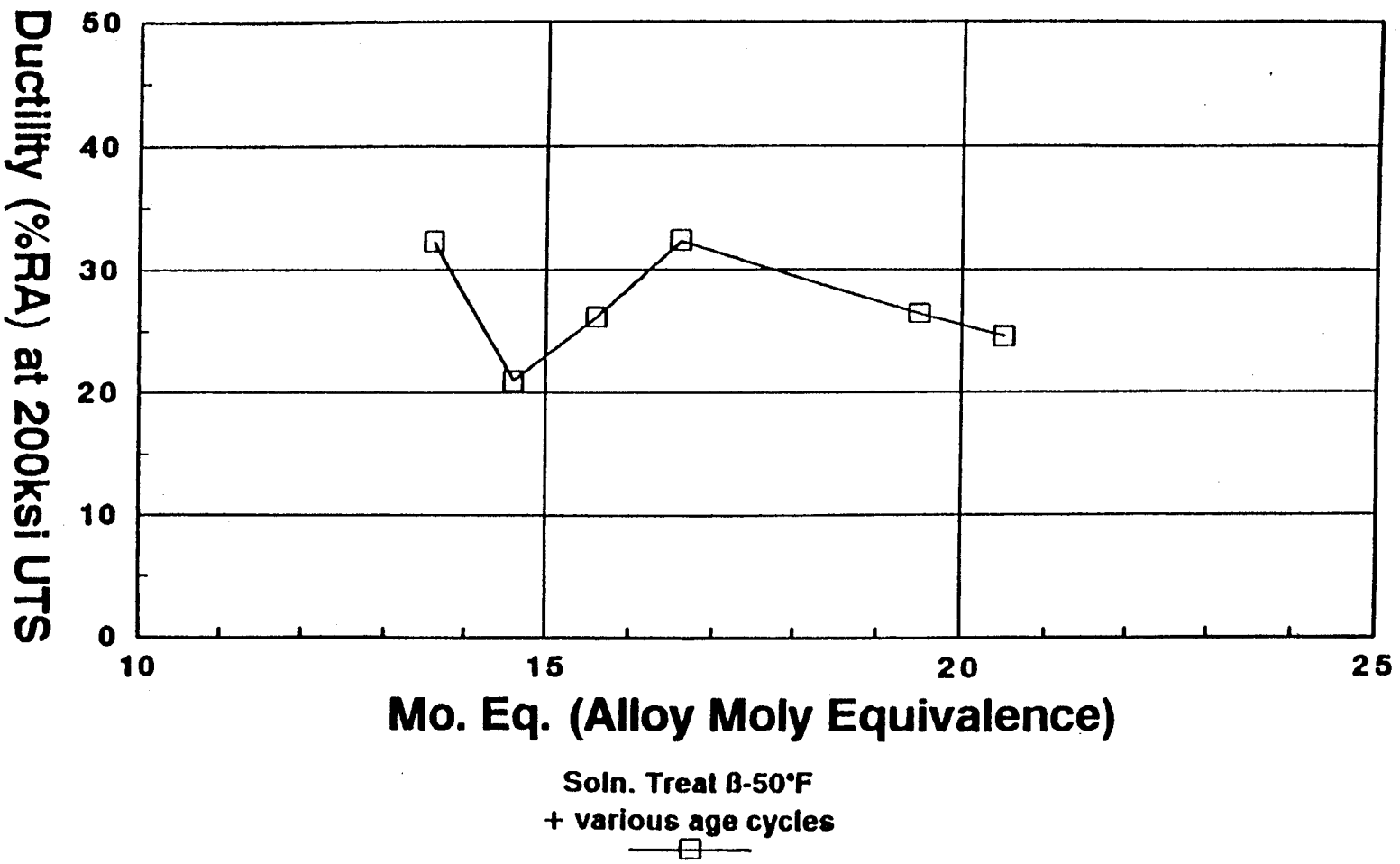
FIG. 2 is a similar graph showing this relationship with the alloy samples being in the solution treated and aged condition.

Table 6 provides such a calculated ductility at a 200 ksi tensile strength level for each alloy. FIG. 2 is a plot of the data presented in Table 6. It may be seen from the FIG. 2 curve that as in the case of the ductility curves in FIG. 1 for solution treated material, a ductility drop within the MoEq. range of about 14.5 to 15.5 is shown. Contrary to the solution-treated samples presented in FIG. 1, there is a slight decrease in ductility when MoEq. is above 16.5; these are, nevertheless, acceptable ductility values up to about 20.5. The data presented in FIGS. 1 and 2 demonstrates the criticality of the ranges for MoEq. in accordance with the invention.

It may be seen that in accordance with the invention it is possible to provide a combination of a relatively low-cost titanium alloy with the desired properties for production of automotive coil springs. Specifically, in the solution treated condition the alloy provides the necessary ductility for the forming operations incident to spring manufacture. Thereafter, the alloy may be aged to achieve a degree of transformation to martensite, alpha, or eutectoid decomposition products that provide the desired increased strength for this application.

What is claimed:

1. A metastable beta titanium-base alloy consisting essentially of Ti-Fe-Mo-Al with Fe and Mo each being at least 4 weight percent, and with said alloy having a MoEq. greater than 16.

2. The alloy of claim 1 having a MoEq. greater than 16.5.

3. The alloy of claim 1 having a MoEq. of 16.5 to 21.

4. The alloy of claim 1 having a MoEq. of 16.5 to 20.5.

5. The alloy of claim 1 having a MoEq. of about 16.5.

6. The alloy of claim 1 exhibiting a minimum % RA of 40% in the solution-treated condition.

7. A metastable beta titanium-base alloy consisting essentially of, in weight percent, 4 to 5 Fe, 4 to 7 Mo, 1 to 2 Al, up to 0.25 $O_2$ and balance Ti and incidental impurities.

8. The alloy of claim 7 having a MoEq. greater than 16.

9. The alloy of claim 7 having a MoEq. greater than 16.5.

10. The alloy of claim 7 having a MoEq. of 16.5 to 21.

11. The alloy of claim 7 having a MoEq. of 16.5 to 20.5.

12. The alloy of claim 7 having a MoEq. of about 16.5.

13. A metastable beta titanium-base alloy consisting essentially of, in weight percent, 4 to 5 Fe, 4 to 7 Mo, 1 to 2 Al, up to 0.25 $O_2$ and balance Ti and exhibiting a minimum % RA of 40% in the solution-treated condition.

14. The alloy of claim 13 having a MoEq. greater than 16.

15. The alloy of claim 13 having a MoEq. greater than 16.5.

16. The alloy of claim 13 having a MoEq. of 16.5 to 21.

17. The alloy of claim 13 having a MoEq. of 16.5 to 20.5.

18. The alloy of claim 13 having a MoEq. of about 16.5.

* * * * *